United States Patent [19]

Roeder et al.

[11] 4,251,205

[45] Feb. 17, 1981

[54] DEVICE FOR IGNITING THE FUEL GAS OF A FLAME CUTTING MACHINE

[75] Inventors: Georg Roeder; Helmut Sachs, both of Frankfurt am Main, Fed. Rep. of Germany

[73] Assignee: Messer Griesheim GmbH, Frankfurt am Main, Fed. Rep. of Germany

[21] Appl. No.: 29,356

[22] Filed: Apr. 11, 1979

[30] Foreign Application Priority Data

Apr. 29, 1978 [DE] Fed. Rep. of Germany ..... 2819108

[51] Int. Cl.[3] ..... F23Q 9/08

[52] U.S. Cl. ..... 431/263; 431/6; 431/353

[58] Field of Search ..... 431/263, 353, 354, 349, 431/6

[56] References Cited

U.S. PATENT DOCUMENTS

| | | | |
|---|---|---|---|
| 2,643,709 | 6/1953 | Haverland | 431/349 |
| 3,168,133 | 2/1965 | Zoschak | 431/349 |
| 3,404,939 | 10/1968 | Saha | 431/263 |
| 3,439,995 | 4/1969 | Hattori | 431/349 |
| 3,627,457 | 11/1971 | Roder | 431/263 |
| 3,858,808 | 1/1975 | Dillon | 431/354 |

*Primary Examiner*—George E. Lowrance
*Attorney, Agent, or Firm*—Connolly and Hutz

[57] ABSTRACT

A flame cutting machine includes an ignition system for igniting the fuel gas which is connected by a transverse bore to a longitudinal bore parallel to the blend canal of the machine.

9 Claims, 1 Drawing Figure

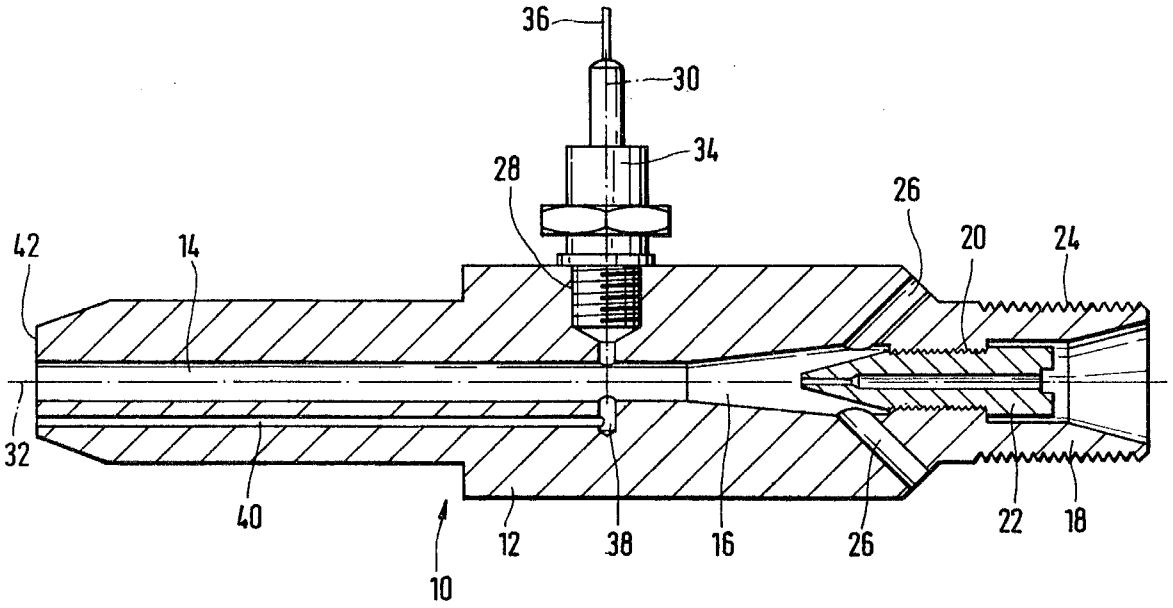
24
20
26
30
36
34
28
18
22
26
16
38
12
10
14
42
40
32

DEVICE FOR IGNITING THE FUEL GAS OF A FLAME CUTTING MACHINE

BACKGROUND OF INVENTION

The present invention is concerned with a device for igniting the fuel gas of a flame cutting machine, consisting of a bunsen burner with a cylindrical canal for the fuel-air mixture and for the pilot flame and of an ignition system associated with this canal.

Such a device, of the above general type, is known in the state of the art (e.g. German Patent DE-OS 2 304 215). In the case of this known ignition device for a flame cutting machine, a so-called spark plug holder, on which a spark is provided, is attached at the lower end of the nozzle. Underneath the spark plug, a hollow body is attached to the spark plug holder, which ends in the outlet region of the nozzle. A part of the outflowing mixture arrives in the hollow body and is ignited there by the spark plug, whereby this ignition flashes back up to the main stream of the mixture flowing from the nozzled and thus ignited this main stream.

With such ignition devices, it is necessary that the fuel pressure lie within a certain pressure range (e.g. between 0.2 and 0.4 bar). Pressures higher than 0.4 bar must be reduced by means of pressure regulators or metering valves, otherwise, no ignition of the fuel-air mixture is assured and/or, because of the flame, breaks off because of the high rate of flow.

SUMMARY OF INVENTION

The object of the present invention is therefore proceeding from the previously described state of the art, to achieve a device for igniting the fuel gas of a flame cutting machine according to the concept of the above-noted general arrangement with which a constantly certain ignition is assured, independently of the fuel pressure. In order to solve the mentioned objective, it is proposed, according to the invention, that a longitudinal bore be provided parallel to the blend canal, which longitudinal bore is connected with the ignition system via a transverse bore.

It is of particular advantage if the transverse bore runs through the blend canal.

According to the preferred form of the embodiment, as seen in the direction flow, the canal is connected, before the transverse bore, with a widening bore into which, on the one hand, bores for the air supply discharge and in which, on the other hand, a pressure nozzle for the fuel is installed.

It is further advantageous if the longitudinal bore has a smaller diameter than the blend canal, preferably half as great.

According to the inventive design of the ignition system, it is assured that, as a result of the installation of a longitudinal bore, parallel to the main canal for the mixture, a partial stream of this mixture comes out of this bore for the purpose of maintaining an auxiliary flame. It is thereby assured that even at high rates of flow in the blend canal, a breaking off of the main flame is prevented by the steady presence of the auxiliary flame.

THE DRAWING

The single FIGURE shows a longitudinal cross-sectional view of a device in accordance with the invention.

DETAILED DESCRIPTION

As shown in the drawing, the inventive device for igniting the fuel gas of a flame cutting machine (not shown) is identified with the reference numeral 10. This device consists of a cylindrical main body 12 in the center of which a blend canal 14 is located. The inner end of the blend canal 14 is connected with a bore 16 which widens, in a conical fashion, in the direction of the hose connection 18 for the fuel.

In the expanded section of the bore 16, in the vicinity of the hose connection 18, the former is equipped with an inner (female) thread 20 which serves to take up a pressure nozzle 22.

The outer (male) thread, of the hose connection 18, which is marked with the reference numeral 24, serves to take up the fuel hose (not represented) through which the fuel is supplied to the pressure nozzle 22.

As is further evident from the drawing, the bore 16 is connected with the atmosphere by several bores 26 located at equal distances to one another, so that, therefore, air can flow into the bore 16 by means of these slits.

In the area of the transition of the blend canal 14 into the expanding bore 16, in the side of the main body 12, an additional threaded bore 28 is provided, the axis 30 of which is at right angle to the longitudinal axis 32 of the blend canal and/or the bore 16. This threaded bore serves to take up the ignition system 34, for example, a glow plug or a spark plug. This ignition system is connected, via a line 36, with the control system of the flame cutting machine which is not represented.

The threaded bore 28 ends in a transverse bore 38 (with the same axis 30) which extends through the blend canal 14 to the side opposite the ignition device 34 in the main body 12. To this transverse bore is connected a longitudinal bore 40 which extends parallel to the blend canal 14 up to the outlet side 42 of the ignition device 10.

In the exemplary embodiment, according to the invention, the blend canal 14 has a diameter of approximately 3 mm whereas the diameter of the longitudinal bore 40 approximately 1 mm.

The fuel reaches the conical bore 16 via the hose connection 18 and the pressure nozzle 22, with said fuel mixing, upon exiting from the pressure nozzle, with the air sucked in by the injection effect, via the passage or bore 26. The forming mixture arrives, as seen in the direction flow, from the tapering bore 16 (the latter serve, in this case, as an accelerating section and to stabilize the mixture) into the blend canal 14. As a result of the injector effect of the pressure nozzle within the entire pressure range of the fuel, an optimal blend ratio of fuel and air is always assured, whereby no additional regulation of the air supply is needed regardless of the fuel pressure.

In the blend canal 14, part of the fuel-air mixture branches off into the transverse bore 38 toward the spark plug 34. The main part of the mixture, on the other hand comes out of the blend canal 14 into the open. The branched off part of the mixture is ignited by the spark plug and then expands, as a burning mixture, in the blend canal 14. Since the rate of the flow of the mixture is greater than its rate of combustion, the flames do not remain inside the blend canal 14, but rather burns in the area of the outlet end 42.

By means of the transverse bore 38, a part of the mixture also arrives in the open from the longitudinal bore 40 and is ignited there because it is in direct proximity to the flame which is fed out of the blend canal 14. Since, therefore, a fuel-air mixture is likewise present in the longitudinal bore 40, a reduction in flow is effected in the event of a high flow of the mixture in the blend canal 14 whereby, at the same time, however, the injector effect of the pressure nozzle 22 is increased. This results from the increase in the cross-section of the flow from the blend canal 14 caused by the longitudinal bore 40. The portion of the fuel-air mixture coming out of the longitudinal bore burns—as mentioned—with a small auxiliary flame up to the main flame of the mixture flow coming out of the canal 14 so that, as a result, a break-off of this main flame is prevented, even at high rates of flow.

The flow ratios of the gas mixture in the blend canal and in the longitudinal bore are always higher than the rate of combustion of the mixture so that, as a result, the flame cannot remain in the blend canal nor in the longitudinal bore. Should the main flame break off at extremely high rates of flow, then it is immediately ignited again by the auxiliary flame of the auxiliary canal 40. This auxiliary flame serves as a constant pilot flame for the main flame. The rate of flow in the longitudinal bore 40 always remains, on account of the cross-sectional ratios of the blend canal 14 and the longitudinal bore 40, below the break-off criterion of the main flame but is always greater than the rate of combustion of the mixture.

Because of the small cross-section of the blend canal (about 3 mm) there results, in the event of a pressure drop, a rapid breakdown of the gas path in the direction of the pressure nozzle (e.g. following a shutdown of the fuel). This means that the retreating flame burns backwards without residue until it is just before the bore of the pressure nozzle 22 and then extinguishes because of a lack of combustion air. The flow of fuel is already so minimal in this area so that no injection effect occurs any more and thus the combustion air can no longer be sucked in.

The above inventive device for igniting the fuel gas, described in connection with a flame cutter, is also suitable with special advantage, for the ignition of scarfing torches regardless of whether one deals with a rotary scarfing torch or with a broad range scarfing torch. As a result of the inventive ignition device, a continuously certain ignition of the gas mixture is attained without expensive measures being needed for this.

As indicated above, in order to ignite a flame cutting machine, a spark plug by means of which the exiting gas mixture is ignited, is provided at its nozzle. But it is necessary that the gas mixture not have that high a pressure because otherwise, ignition of the mixture does not occur because of the high rate of flow. In accordance with the invention a separate ignition device is achieved which continuously ignites with certainty independently of the pressure. This is accomplished by an additional canal or bore for the pilot flame which is connected with the actual ignition device provided parallel to the blend canal. Because of this arrangement, a certain ignition of the ignition system and a steady burning of the pilot flame by means of which the ignition of the flame cutter then results.

What is claimed is:

1. In a device for igniting the fuel gas of a flame cutting machine, consisting of a bunsen burner with a cylindrical blend canal for the fuel-air mixture used for the pilot flame and of an ignition system associated with this canal, the improvement being a longitudinal bore parallel to said blend canal, said longitudinal bore being connected with said ignition system by a transverse bore, and said transverse bore intersecting said blend canal.

2. Device according to claim 1, characterized therein that said blend canal is connected with a widening bore upstream from said transverse bore, air supply passages discharging into said widening bore, and a pressure nozzle for the fuel being installed in said widening bore upstream from said air supply passages.

3. Device according to claim 2, characterized therein that said longitudinal bore is of a diameter smaller than said blend canal.

4. Device according to claim 3, characterized therein that said longitudinal bore diameter is one half said blend canal diameter.

5. Device according to claim 3, characterized therein that a spark plug is provided as said ignition system.

6. Device according to claim 1, characterized therein that said blend canal is connected with a widening bore upstream from said transverse bore, air supply passages discharging into said widening bore, and a pressure nozzle for the fuel being installed in said widening bore upstream from said air supply passages.

7. Device according to claim 1, characterized therein that said longitudinal bore is of a diameter smaller than said blend canal.

8. Device according to claim 7, characterized therein that said longitudinal bore diameter is one half said blend canal diameter.

9. Device according to claim 1, characterized therein that a spark plug is provided as said ignition system.

* * * * *